US008020416B2

(12) United States Patent
Talmage et al.

(10) Patent No.: US 8,020,416 B2
(45) Date of Patent: Sep. 20, 2011

(54) SAFE FOR VEHICLE

(76) Inventors: Kimberley Talmage, Coral Springs, FL (US); William Talmage, Coral Springs, FL (US)

( * ) Notice: Subject to any disclaimer, the term of this patent is extended or adjusted under 35 U.S.C. 154(b) by 556 days.

(21) Appl. No.: 12/194,799

(22) Filed: Aug. 20, 2008

(65) Prior Publication Data

US 2010/0043682 A1 Feb. 25, 2010

(51) Int. Cl.
*E05B 65/46* (2006.01)

(52) U.S. Cl. ..... 70/85; 70/63; 109/45; 109/50; 109/58.5; 109/59 R

(58) Field of Classification Search ..... 70/63, 85, 70/86; 109/19, 45, 47, 50, 58.5, 59 R
See application file for complete search history.

(56) References Cited

U.S. PATENT DOCUMENTS 3,083,896 A * 4/1963 Cairelli et al. ..... 232/15
3,842,761 A * 10/1974 Bloom ..... 109/59 R
3,970,010 A * 7/1976 Cantley ..... 109/56
4,145,978 A * 3/1979 Johnson et al. ..... 109/59 R
4,148,265 A * 4/1979 Acosta ..... 109/59 R
4,258,632 A * 3/1981 LaPointe ..... 109/59 R
4,524,904 A * 6/1985 Masse et al. ..... 232/7
4,800,822 A * 1/1989 Adkins ..... 109/19
5,317,888 A * 6/1994 Towns ..... 70/63
5,488,914 A * 2/1996 Ouellette ..... 109/56
5,619,932 A * 4/1997 Efland et al. ..... 109/24.1
6,845,640 B2 * 1/2005 Loeff et al. ..... 70/63
7,305,858 B1 * 12/2007 Wu et al. ..... 70/58
7,807,923 B2 * 10/2010 Moran ..... 174/50
2004/0045329 A1 * 3/2004 Farnham et al. ..... 70/63

* cited by examiner

*Primary Examiner* — Suzanne Barrett
(74) *Attorney, Agent, or Firm* — James A. Italia; Italia IP

(57) ABSTRACT

A safe which is attachable to a motor vehicle. The safe may have a door bearing a lock which is centered on the door so that access to the lock is equal from opposed sides of the safe. The safe may have a slide-out drawer which rides on a track, in which case the track and drawer are centered within the safe. The drawer may be locked by a lock which is centered within one face of the drawer. The safe may have a mounting flange bearing at least one hole for engaging a retention element such as threaded fasteners or a tether.

13 Claims, 6 Drawing Sheets

SAFE FOR VEHICLE

FIELD OF THE INVENTION

The present invention relates to safes, and more particularly to safes for use in motor vehicles.

BACKGROUND OF THE INVENTION

Safes for motor vehicles have long been desired and proposed. Motor vehicles have evolved from their original designs, which were often quite spacious and laid out with perpendicular and parallel surfaces. Notably, modern vehicles have become relatively compact, and prone to having curved and irregular interior surfaces. This presents certain obstacles to what would otherwise be an uncomplicated exercise in design and installation of safes. Given the trend in interior design of vehicles, it would appear that safes, if not made objectionably small, must be custom fitted to a particular vehicle design.

Custom designed and fitted safes present objections in manufacturing. A supplier or vendor of safes would be obliged to fabricate and stock a large inventory to accommodate the many models and designs of safes which would be necessary to offer consumers a product for the many vehicles which consumers may own.

There is also the issue of where to mount a safe within a vehicle. Unobtrusive spaces exist beneath seats, on vertical wall surfaces, and in the trunk. However, each of these choices may impose additional restrictions on safe design.

Therefore, there exists a need in the art for versatility of design which would enable any one design of a safe to fit into different locations of motor vehicles, and which would enable one design of a safe to be accommodated by different vehicles.

SUMMARY OF THE INVENTION

The present invention provides safes suitable for mounting in vehicles which are more versatile in their ability to be mounted in any one particular vehicle. In particular, symmetry of design enables safes to be mounted in either of two opposed orientations according to one aspect of the invention. Illustratively, a slide or guide for a safe having a drawer may be arranged so that the housing may be inverted and the drawer may still open in the upward direction. In another example, a lock may be symmetrically located with respect to the upper and lower surfaces of an associated housing, may be symmetrically located with respect to the left-to-right direction relative to an associated housing, or both.

According to other aspects of the invention, a vehicle safe may have flanges for surface mounting, eyes for engaging a tether for tethering to the associated vehicle, or both.

According to still other aspects of the invention, the safe may comprise a drawer, may have a hinged door providing access to the interior, or may have a removable door providing access to the interior.

It is an object of the invention to provide safes for vehicles which are versatile in their requirements and abilities to be installed within a subject vehicle.

It is an object to reduce the number of models or designs of safes which would be required to assure availability of a suitable model or design for the many motor vehicles which are commercially available to the motoring public.

It is an object of the invention to be able to utilize conventional fabrication methods to fabricate safes for installing within motor vehicles.

It is an object of the invention to provide improved elements and arrangements thereof by apparatus for the purposes described which is inexpensive, dependable, and fully effective in accomplishing its intended purposes.

These and other objects of the present invention will become readily apparent upon further review of the following specification and drawings.

BRIEF DESCRIPTION OF THE DRAWINGS

Various objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION

Figure 5:
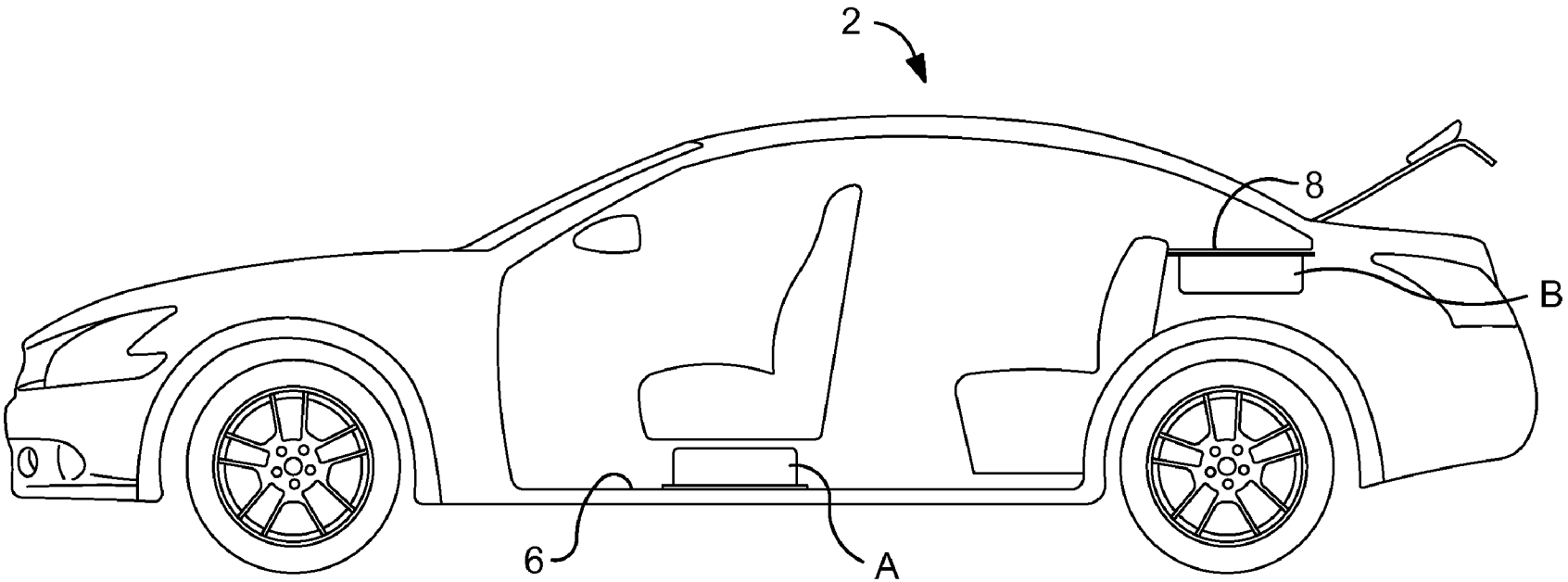
FIG. 5 is a side view of a passenger automobile, illustrating possible mounting arrangements for a safe such as any of the safes shown in FIGS. 1A-4.
Figure 6:
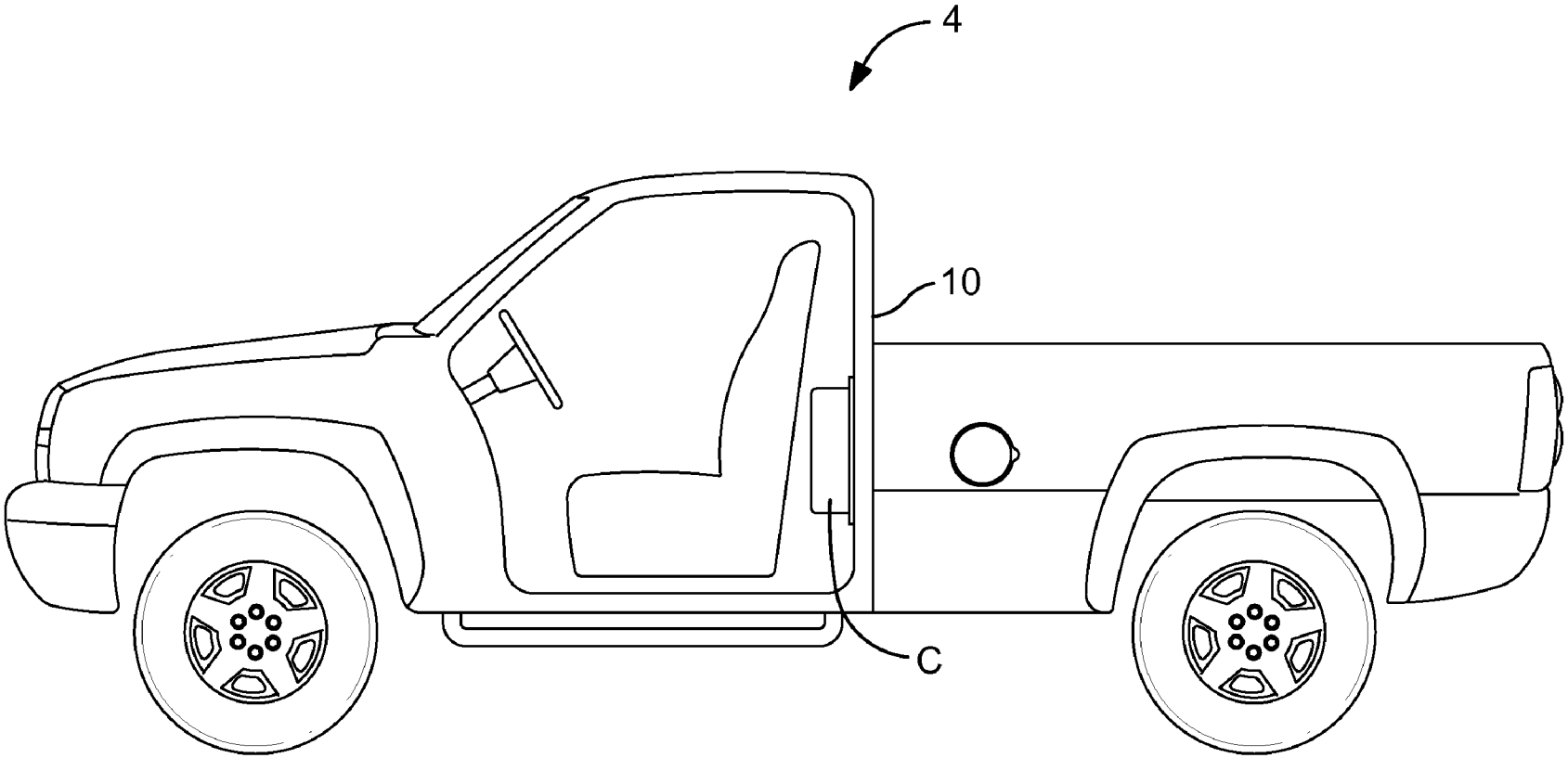
FIG. 6 is a side view of a light truck illustrating a possible mounting arrangement for a safe such as any of the safes shown in FIGS. 1A-4.

FIGS. 1A-2B of the drawings show a safe 100 for a motor vehicle (e.g., such as an automobile 2 as shown in FIG. 5 or a light truck 4 as shown in FIG. 6), which safe 100 is mountable in at least two positions on the motor vehicle. The safe 100 may comprise a receptacle 102 defined within a housing 104. The housing 104 may comprise a top panel 106, a perimetric wall 108, and a bottom panel 110. The housing 104 may be a parallelepiped as shown having a horizontal center plane 112 (see FIG. 7, described hereinafter) which is parallel to the top panel 106 and to the bottom panel 110, and which is located equidistantly therebetween. The perimetric wall 108 may extend continuously about the periphery of the housing 104 except at one side which opens to receive a drawer 114. Only the front panel 116 of the drawer 114 is visible in FIGS. 1A and 1B. Mounted to the front panel 116 are a handle 118 and a lock 120.

It should be mentioned that orientational terms such as top and bottom refer to the subject matter as it is depicted in the drawings. As will be further detailed hereinafter, a safe such as the safe 100 may be mounted in different positions, so that it may be said that there is no surface which is always the top or bottom. Therefore, orientational terms must be understood as providing semantic basis for purposes of description, and do not limit the invention or its component parts in any particular way.

Figure 1A:
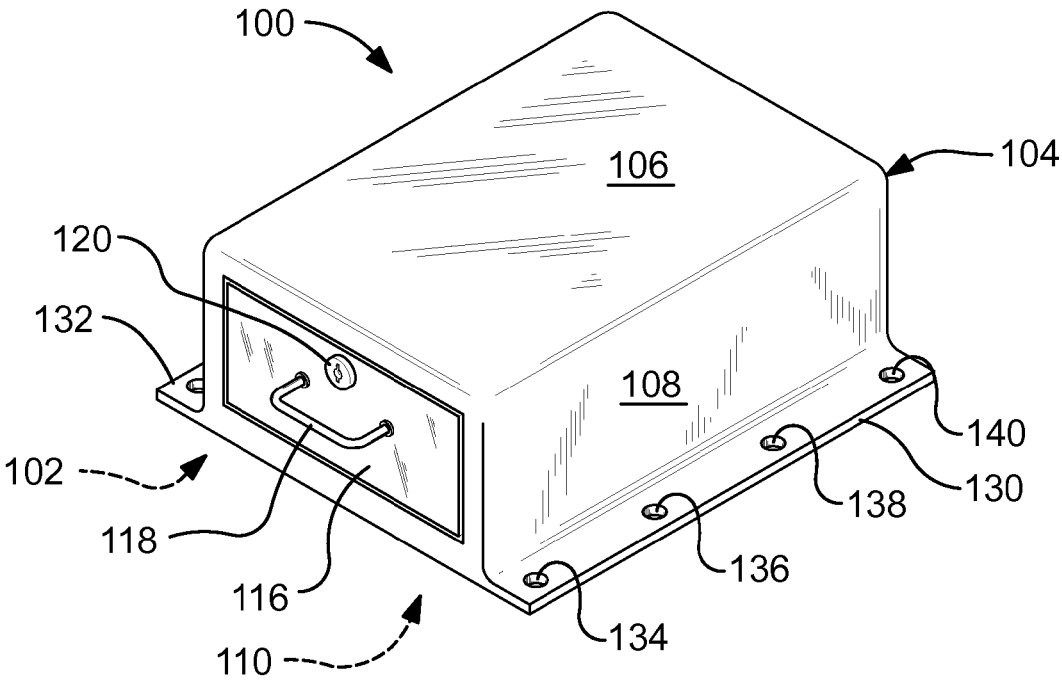
FIG. 1A is a perspective view of a safe according to at least one aspect of the invention.
Figure 1B:
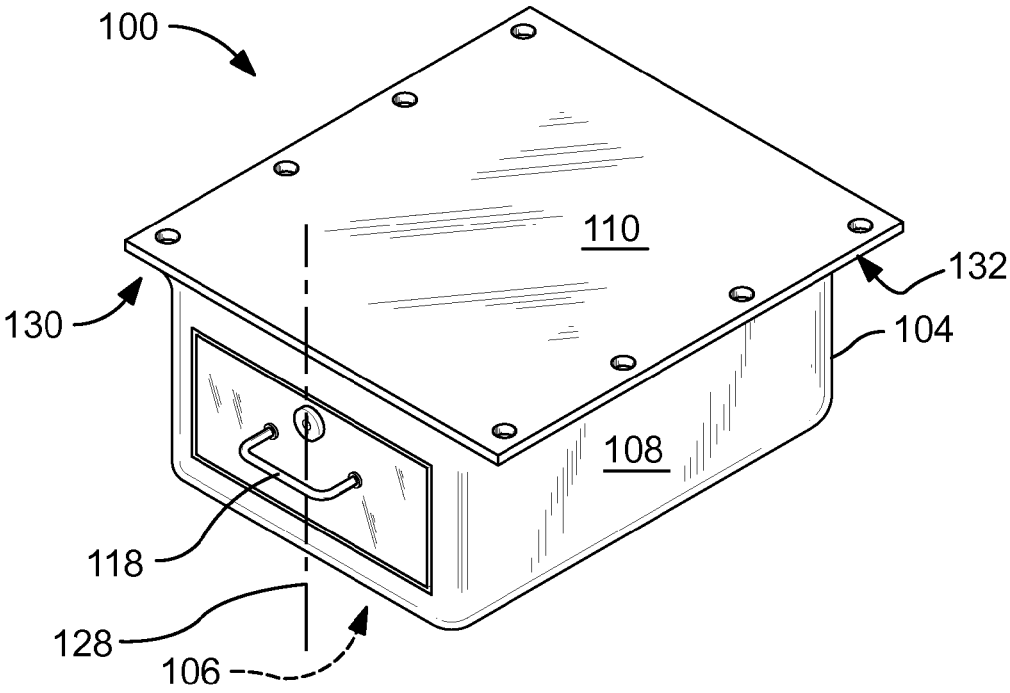
FIG. 1B is a perspective view of the safe of FIG. 1A shown in an alternative orientation. according to at least one aspect of the invention.
Figure 2A:
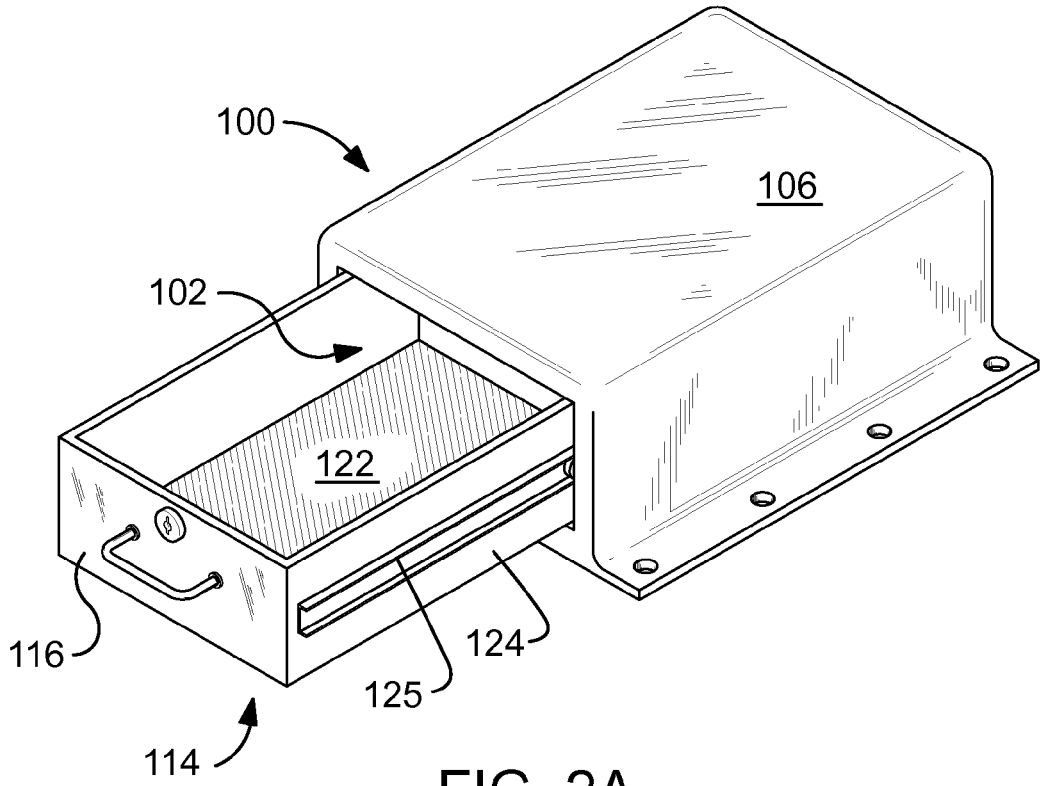
FIG. 2A is a perspective view of the safe of FIG. 1A, showing a drawer in the open position.
Figure 2B:
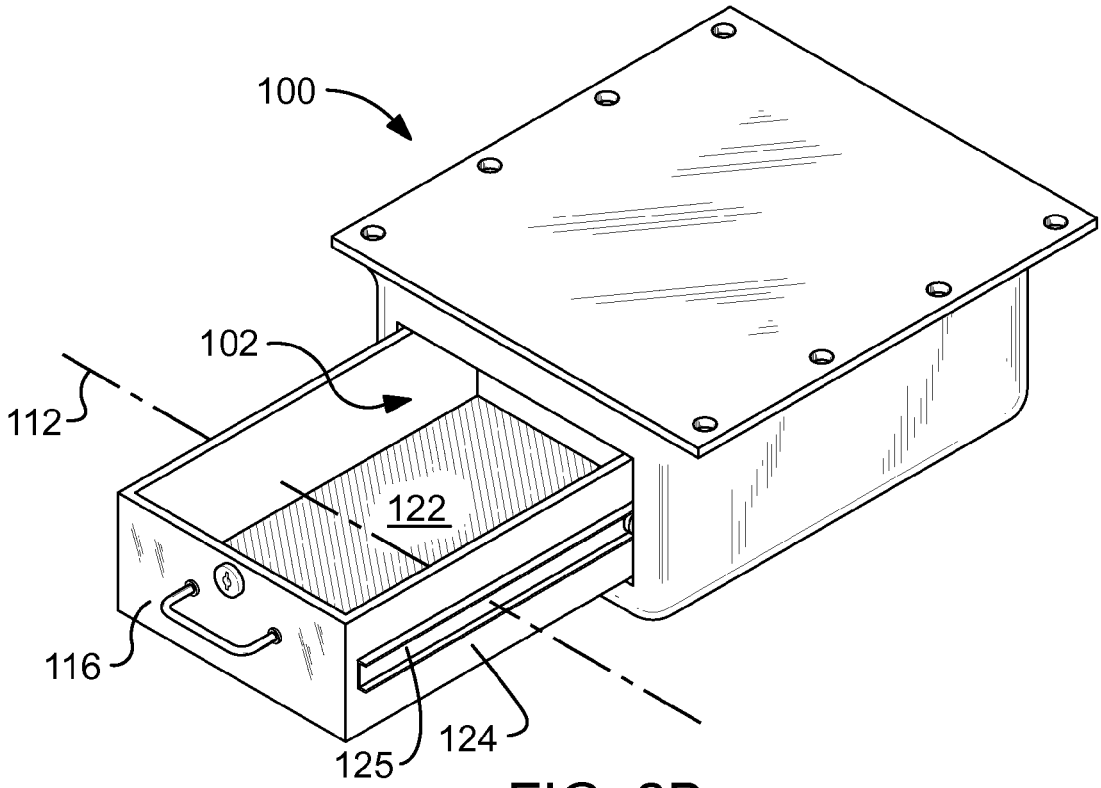
FIG. 2B is a perspective view of the safe of FIG. 2A, showing a drawer in the open position.

Access to the receptacle 102, which is a void bounded by the upper panel 106, the perimetric wall 108, and the bottom panel 110, is obtained by partly or fully withdrawing the drawer 114 therefrom. The drawer 114 is disposed to occupy the receptacle 102 and to move reversibly between a protected or inaccessible location within the receptacle 102, as illustrated in FIGS. 1A and 1B, and an exposed position wherein contents of the drawer 114 are exposed to access from outside the safe 100, as illustrated in FIGS. 2A and 2B. Of course, the front panel 116 remains visible when the drawer 114 is in the protected location.

The drawer 114 may comprise a floor 122 and a perimetric wall 124 projecting generally perpendicularly from the floor 122 to define a drawer storage space. The horizontal center plane 112 may be disposed parallel to the floor 122.

A guide such as a track 125 is disposed to guide the drawer 114 to move between the protected location and the exposed position. The track or guide 125 is centered on the respective horizontal center plane 112 of the drawer 114 and of the receptacle 102.

The front panel 116 of the drawer 114 forms a closure which seals the receptacle 102 from ready access from the exterior of the safe 100. The closure is located on one side of the receptacle 102 and is disposed to close the receptacle 102 when the drawer 114 is within the receptacle 102.

The lock 120 is disposed to selectively lock and unlock the closure, and may be of the keyed lock type which is operable by a key (not shown) and which comprises an interference member such as a finger (such as the finger 226 shown in FIG. 3) which selectively engages a wall or panel of the receptacle 102 to establish interference opposing withdrawal of the drawer 114 from the receptacle 102, and which selectively moves the interference member out of interference with the receptacle 102 to enable the drawer 114 to be exposed to the exterior of the safe 100. This type of lock is conventional and need not be detailed further herein.

The receptacle 102 has a vertical longitudinal center plane 128 which extends parallel to the track 124. The lock 120 is in a location intersected by the vertical longitudinal center plane 128. This is a useful feature since the lock 120 will be equally accessible even when the housing 104 is inverted, as may be performed to mount the safe 100 to the underside of a horizontal vehicle surface rather than to the upper side of a horizontal vehicle surface.

The safe 100 may include a mounting for mounting the housing 104 to the motor vehicle. The mounting may take the form of flanges, such as flanges 130, 132. Each flange 130 or 132 may bear holes such as the holes 134, 136, 138, 140, for passing fasteners, such as screws, bolts, rivets, and the like (none shown). The flanges 130, 132 may be parallel to the floor 122 of the drawer 114, and may be located at the bottom panel 110 of the housing 104. This relationship enables the flanges 130, 132 to sit flush against a vehicle surface to which the safe 100 is to be mounted.

FIGS. 1B and 2B show the safe 100 in an inverted position relative to that shown in FIG. 1. It will be appreciated that the safe 100 may be mounted to an overhead environmental surface (not shown) as well as to an environmental surface which is below the safe 100. It will be appreciated that should the inverted position be employed, the orientation of the drawer 114 within the housing 104 may be reversed so that the receptacle 102 will open upwardly. Manual access to the contents and to the lock 120, and operability of the track 124 will be unaffected by the new position. This will be apparent upon examining FIG. 2B, which shows the drawer 114 in the open position, and with the housing 104 in the inverted position.

Figure 3:
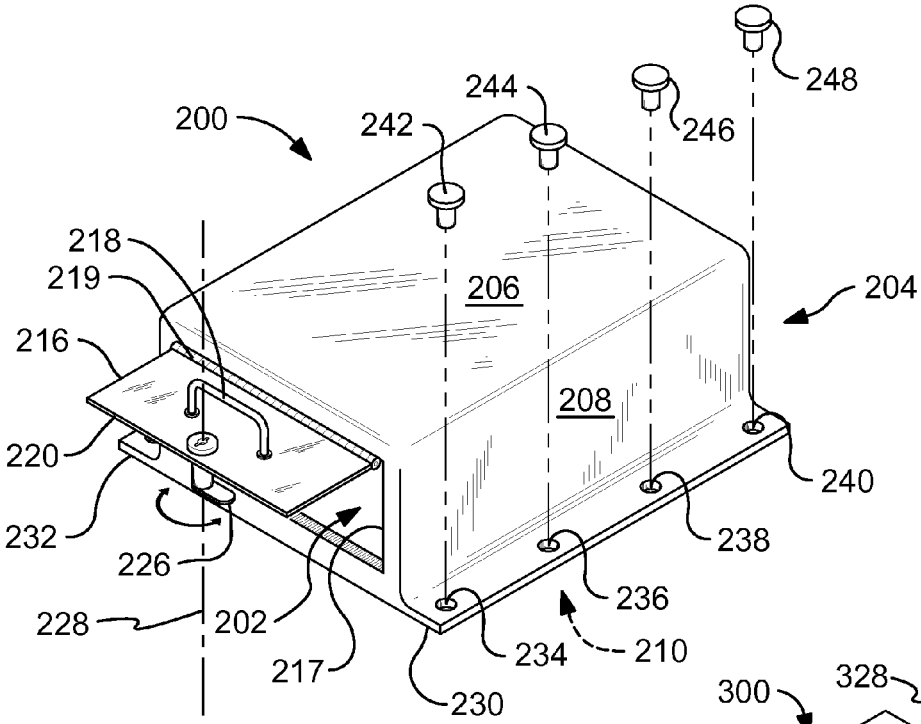
FIG. 3 is a perspective view of a safe according to at least one further aspect of the invention.

FIG. 3 shows a safe 200 which like safe 100 is mountable in at least two positions on a motor vehicle. The safe 200 may comprise a receptacle 202 defined within a housing 204. The housing 204 may comprise a top panel 206, a perimetric wall 208, and a bottom panel 210. The housing 204 may be a parallelepiped as shown having a vertical longitudinal center plane 228 which is parallel to the top panel 206 and to the bottom panel 210, and which is located equidistantly therebetween. The perimetric wall 208 may extend continuously about the periphery of the housing 204 except at one side which opens to expose the receptacle 202. A closure such as a door 216 which may be pivotally hinged to the housing 204 so as to selectively close and expose an opening 217 formed in the perimetric side wall 208. A piano hinge 219 may be provided to hinge the door 216 to the housing 204. The closure is located on one side of the housing 204 and is disposed to expose the interior of the receptacle 202 and to close the interior of the receptacle 204. The closure may include a handle 218 exposed to the exterior of the safe 200.

A lock 220 may be mounted to the front panel 216. The lock 220 may be similar to the lock 120. The finger 226 which establishes interference with the housing 204 is visible in FIG. 3. The lock 220 may be mounted on the door 216 at a location which is intersected by the vertical longitudinal center plane 228 (see FIG. 8, described hereinafter). This orientation renders the safe 200 suitable for mounting to an environmental surface located below the safe 200, or alternatively, to an environmental surface located above the safe 200. In either mounting choice, the lock 220 will be at the center of the door 216, so that access to the lock 220 in both mounting choices will not be awkward or unduly limited. Of course, the lock 220 may be mounted on a suitable place on the housing 204, and its interference finger, such as the interference finger 226, may engage the door 216 if desired.

A mounting for mounting the safe 200 to an environmental surface of a motor vehicle may be provided, for example in the form of flanges 230, 232. The flanges 230, 232 may be parallel to the floor 210 of the housing 204. The flanges 230, 232 may bear holes such as the holes 234, 236, 238, 240, for engaging a retention element.

A retention element may comprise a plurality of headed, threaded fasteners such as bolts 242, 244, 246, and 248, or any other type such as screws, rivets, expanding fasteners, and still others.

Figure 4:
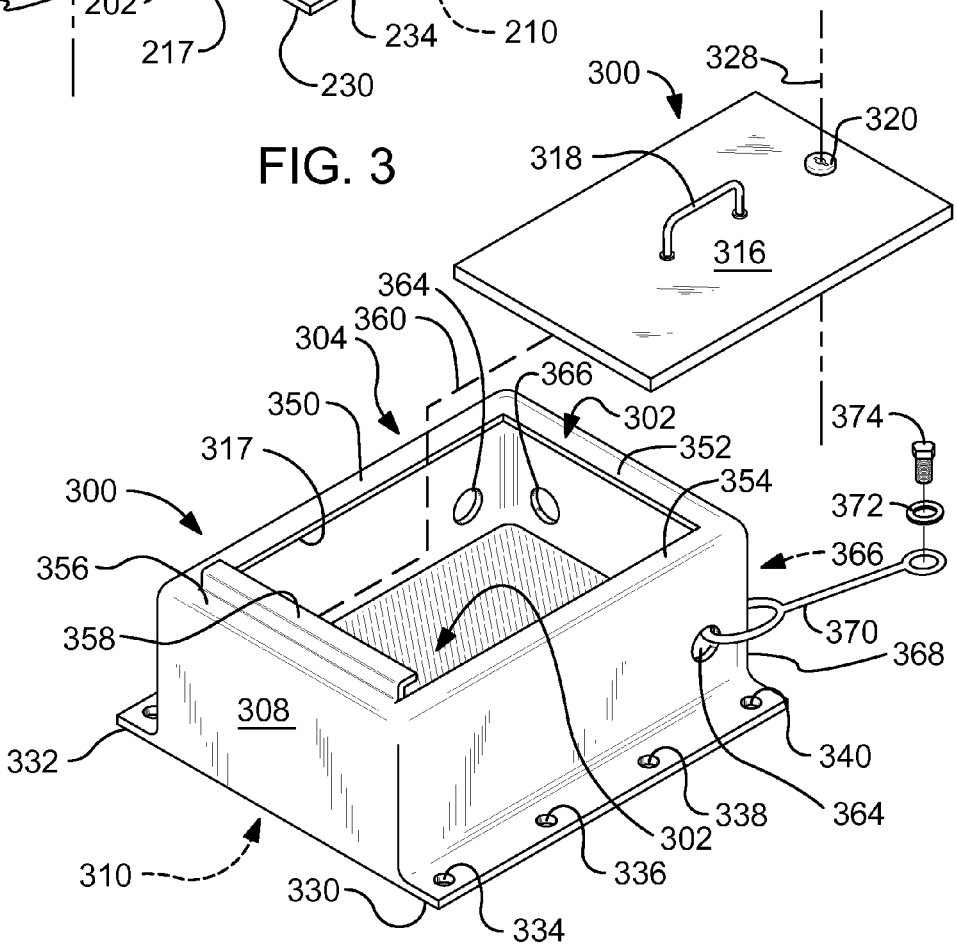
FIG. 4 is an exploded perspective view of a safe according to still a further aspect of the invention.

FIG. 4 shows a safe 300 according to a further aspect of the invention. The safe 300 is mountable in at least two positions on a motor vehicle. The safe 300 may comprise a receptacle 302 defined within a housing 304. The housing 304 may comprise a parallelepiped including a perimetric wall 308 and a bottom panel 310. The upper surface of the housing 304 may comprise an opening 317 which may be surrounded or framed by horizontally oriented members 350, 352, 354, and 356. An angled flange 358 may be fixed to the horizontally oriented member 356 to receive and entrap a closure 316 which may be moved into engagement with the housing 304 as indicated by the broken line 360.

The housing 304 and closure 316 may have a vertical longitudinal center plane 328 (see FIG. 8, described hereinafter) which is parallel to the holes 334, 336, 338, 340 formed in a flange 330. The flange 330 may be a structural and functional counterpart of the flange 230 of FIG. 3, which, with or without the opposed flange 332, forms a mounting for mounting the safe 300 to an environmental surface.

The closure 316, which is removable from the housing 304, may include a handle 318 and a lock 320. The handle 318 and the lock 320 may be structural and functional counterparts of respective handle 218 and lock 220 of FIG. 3. The closure 316 is secured by engagement with the angled flange 358 together with conventional engagement of the horizontally oriented member 352 by the finger of the lock 320. The finger of the lock 320 may be similar to the finger 226 of the lock 220 of FIG. 3.

The lock 320 may be mounted on the closure 316 at a location which is intersected by the vertical longitudinal center plane 328. As with the safe 200, access to the lock 320 will not be awkward or unduly limited in different mounting positions.

The mounting for mounting the safe 300 to its associated vehicle may comprise holes such as the holes 366, 364, for receiving a tether 370. The tether 370 may be used for example to tether the safe 300 to the mounting bolt of a vehicle seat or some other sturdy component (none shown in their entirety) of the vehicle in which the safe 300 is mounted. As depicted, the holes 364 and 366 are adjacent a corner 368. The tether 370 may be passed through both holes 364, 366 so as to engage the housing 304 without interfering with the receptacle 302 or closure 316.

The mounting for the safe 300 may comprise fasteners such as the bolts 242, 244, 246, 248, or may comprise a tether 370 as described above, or both.

Referring now to FIGS. 5 and 6, a safe such as the safes 100, 200 and 300 may be mounted to a vehicle in several different positions or orientations. In FIG. 5, a safe A such as either of the safes 100, 200 is shown mounted to the floor 6 of a passenger automobile 2. The closure of the safe A faces either the front or the rear of the passenger automobile 2, and can be accessed by hand from either the front or rear foot well of the passenger automobile 2.

A second safe B, such as any of the safes 100, 200, 300 is shown mounted below the rear deck 8 of the passenger automobile 2.

Mounting of the safes A and B may utilize for example fasteners such as the bolts 242, 244, 246, 248, with equivalent fasteners provided on both flanges, such as the flanges 230 and 232. Alternatively, safe A may be a safe such as the safe 300 having holes such as the holes 364, 366, and may be tethered to a seat mounting bolt or support (not specifically shown) or any sturdy structural part of the seats of the passenger vehicle 2.

FIG. 6 shows a mounting of a safe C, which may be for example any of the safes 100, 200, 300 to a vertical surface such as the rear wall 10 of the cabin of the light truck 4. Mounting of the safe C may utilize for example fasteners such as the bolts 242, 244, 246, 248, with equivalent fasteners provided on both flanges, such as the flanges 230 and 232.

Centering of certain specified components of the various safes, such as the track 125 (FIGS. 2A and 2B) on the horizontal center plane 112; and the locks, such as the locks 120, 220, 320 centered on the respective vertical longitudinal planes 128, 228 and 328, assures unchanging orientation of closures such as the door 116, the door 216, and the closure 316 with respect to visual and manual access despite the actual selected position or orientation of mounting.

Figure 7:
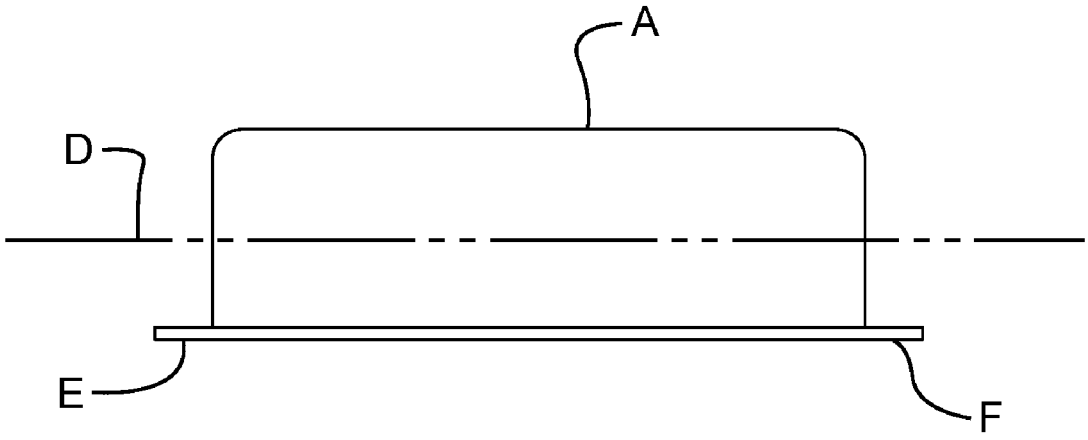
FIG. 7 is a diagrammatic end view of a safe such as any of the safes shown in FIGS. 1A-4, and illustrates a horizontal center plane of the referenced safes.

FIG. 7 illustrates a horizontal center plane D with respect to the safe A (which of course represents any safe according to an aspect of the invention, such as the safes 100, 200, 300). Mounting flanges E and F respectively represent any of the mounting flanges, such as the flanges 130 and 132, 230 and 232, or 330 and 332, for example.

Figure 8:
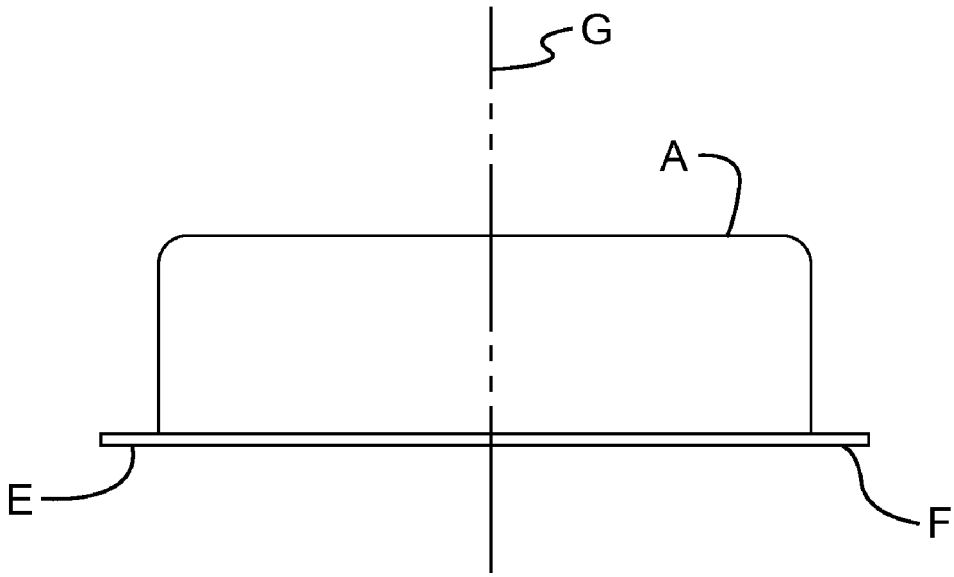
FIG. 8 is a diagrammatic end view of a safe such as any of the safes shown in FIGS. 1A-4, and illustrates a vertical center plane of the referenced safes.

FIG. 8 illustrates a vertical longitudinal center plane G, which represents any of the vertical longitudinal center planes 128, 228, and 328 for example.

The present invention is susceptible to variations and modifications which may be introduced thereto without departing from the inventive concept. For example, it is to be understood that due to the conceptual description presented herein, components presented in the singular may be provided in the plural. Where feasible, it would be possible to provide a single component rather than a plurality of components.

Locations of components may be changed from those described. Illustratively, a lock such as the lock 120 may be mounted in its associated housing such as the housing 104 rather than in the closure as described.

The location of any of the closures, such as the doors 116 and 216 and the closure 316 may be relocated on their respective housings, such as the housings 104, 204 or 304, as desired.

Additional mounting positions for a safe such as the safes 100, 200, 300 are contemplated. If the anticipated weight is not excessive, a safe may be mounted to the underside of the trunk lid of the passenger automobile, for example.

The nature of the closure 316 may be varied. For example, the horizontally oriented members 350, 352, 354, and 356 may be deleted in favor of another arrangement. For example, the closure 316 may be provided with downwardly depending walls or tabs (not shown) which cooperate closely with the opening 317 and which prevent lateral sliding of the closure 316.

Certain components, such as walls or panels of the various housings, such as for example the perimetric wall 308 may be discontinuous or perforated. That is, the perimetric wall may comprise expanded metal, or parallel but spaced apart strips such as in an arrangement similar to that of a picket fence for example.

While the present invention has been described in connection with what is considered the most practical and preferred embodiment, it is to be understood that the present invention is not to be limited to the disclosed arrangements, but is intended to cover various arrangements which are included within the spirit and scope of the broadest possible interpretation of the appended claims so as to encompass all modifications and equivalent arrangements which are possible.

We claim:

1. A safe for a motor vehicle which is mountable in at least two positions on the motor vehicle, comprising:

a receptacle having a horizontal center plane, a top panel, a perimetric wall, and a bottom panel;

a drawer disposed to occupy the receptacle and to move reversibly between a protected location within the receptacle and an exposed position wherein contents of the drawer are exposed to access from outside the safe, wherein the drawer comprises:

a floor and a perimetric wall projecting generally perpendicularly from the floor to define a drawer storage space, a horizontal center plane which is generally aligned with the horizontal center plane of the receptacle;

a guide disposed to guide the drawer to move between the concealed location and the exposed position, wherein the guide is generally centered on the respective center planes of the drawer and of the receptacle, wherein the guide is configured to allow the drawer to be movably coupled with the housing in a first orientation wherein the floor of the drawer is relatively close to the bottom panel of the receptacle, and wherein the guide is also configured to allow the drawer to be movably coupled with the housing in a second orientation opposite the first orientation wherein the floor of the drawer is relatively further from the bottom panel of the receptacle; and a closure which is located on one side of the receptacle and which is disposed to surround the drawer and to close the receptacle when the drawer is within the receptacle, wherein the closure comprises a handle exposed to the exterior of the safe;

a lock disposed to selectively lock and unlock the closure; and a mounting for mounting the receptacle to the motor vehicle.

2. The safe of claim 1, wherein the guide comprises a track.

3. The safe of claim 1, wherein a portion of the perimetric wall of the of the drawer includes a front wall, and wherein the closure comprises the front wall.

4. The safe of claim 1, wherein the lock is a keyed lock which is operable by a key and which comprises an interference member which selectively engages the receptacle to establish interference opposing withdrawal of the drawer from the receptacle, and which selectively moves the interference member out of interference with the receptacle to enable the drawer to be exposed to the exterior of the safe.

5. The safe of claim 1, wherein the receptacle has a vertical longitudinal center plane, and the lock is in a location intersected by the vertical longitudinal center plane.

6. The safe of claim 1, wherein the mounting comprises a flange bearing holes for fasteners.

7. The safe of claim 6, wherein the flange is parallel to the floor of the drawer.

8. A safe for a motor vehicle which is mountable in at least two positions on the motor vehicle, comprising:

a housing comprising a floor, a perimetric side wall having an opening, thereby defining a receptacle within the housing, a top panel, and a vertical longitudinal center plane passing through the opening of the side wall;

a closure which is located on one side of the housing and which is disposed to expose the interior of the receptacle and to close the interior of the receptacle, wherein the closure comprises a handle exposed to the exterior of the safe;

a lock disposed to selectively lock and unlock the closure, wherein the lock is located on the closure at a location which is intersected by vertical center plane;

a mounting for mounting the housing to the motor vehicle;

wherein the perimetric side wall includes a first wall portion and a second wall portion, a corner between the first wall portion and the second wall portion, a first hole in the first wall portion near the corner and a second hole in the second wall portion near the corner;

a drawer having a drawer floor and a drawer perimetric wall projecting generally perpendicularly from the drawer floor to define a storage space, the drawer having a center drawer plane which is generally aligned with a center plane of the receptacle, the drawer disposed to occupy the receptacle and to move reversibly between a protected location within the receptacle and an exposed position wherein the storage space is accessible from outside the housing; and the guide being generally centered on the respective center drawer plane and the center plane of the receptacle;

wherein the guide is configured to allow the drawer to be movably coupled with the housing in a first orientation wherein the drawer floor is relatively close to the floor of the receptacle, and to guide the drawer to move between the protected location and the exposed position; and wherein the guide is also configured to allow the drawer to be movably coupled with the housing in a second orientation opposite the first orientation wherein the drawer floor is relatively further from the floor of the receptacle and to guide the drawer to move between the protected location and the exposed position.

9. A safe for a motor vehicle comprising:

a housing comprising a floor and a top panel spaced apart from the floor, perimetric side walls disposed between the floor and the top panel thereby defining a receptacle within the housing;

a drawer having a drawer floor and drawer perimetric walls projecting generally perpendicularly from the drawer floor to define a storage space, the drawer having a center drawer plane which is generally aligned with a center plane of the receptacle, the drawer disposed to occupy the receptacle and to move reversibly between a protected location within the receptacle and an exposed position wherein the storage space is accessible from outside the housing; and the guide being generally centered on the respective center drawer plane and the center plane of the receptacle;

wherein the guide is configured to allow the drawer to be movably coupled with the housing in a first orientation wherein the drawer floor is relatively close to the floor of the receptacle, and to guide the drawer to move between the protected location and the exposed position; and wherein the guide is also configured to allow the drawer to be movably coupled with the housing in a second orientation opposite the first orientation wherein the drawer floor is relatively further from the floor of the receptacle and to guide the drawer to move between the protected location and the exposed position.

10. The safe of claim 9, wherein the housing includes a corner wherein a first of the perimetric side walls meets a second of the perimetric side walls, a first hole in the first side wall near the corner and a second hole in the second side wall near the corner, the first and second holes configured to allow a tether to pass into the first hole and out of the second hole.

11. The safe of claim 9, wherein the receptacle includes an opening through which at least portions of the drawer moves between the protected location and the exposed position, and wherein the drawer includes a front panel configured to substantially enclose the receptacle when the drawer is in the concealed location, a lock located on the front panel, the lock having a finger configured to establish interference with a top portion of the opening when the drawer is in the first orientation and configured to establish interference with a bottom portion of the opening when the drawer is in the second orientation.

12. The safe of claim 9, further comprising a mounting arranged in a plane above the storage space when the housing is mounted to the motor vehicle.

13. The safe of claim 9, further comprising a mounting arranged in a substantially vertical plane to one side of the storage space when the housing is mounted to the motor vehicle.

* * * * *